US007267922B2

(12) United States Patent
Choi

(10) Patent No.: US 7,267,922 B2
(45) Date of Patent: Sep. 11, 2007

(54) METHOD OF PREPARING PARTICULATE PHASE TONER USING FRACTIONAL DISSOLUTION AND PARTICULATE PHASE TONER PREPARED USING THE SAME

(75) Inventor: Seok-hoon Choi, Suwon-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 371 days.

(21) Appl. No.: 10/944,788

(22) Filed: Sep. 21, 2004

(65) Prior Publication Data

US 2005/0112491 A1 May 26, 2005

(30) Foreign Application Priority Data

Nov. 21, 2003 (KR) ..... 10-2003-0083048

(51) Int. Cl.
*G03G 9/08* (2006.01)

(52) U.S. Cl. ..... 430/137.18; 430/108.1

(58) Field of Classification Search ..... 430/137.18, 430/108.1

See application file for complete search history.

(56) References Cited

U.S. PATENT DOCUMENTS 6,124,070 A 9/2000 Baba et al.

6,232,029 B1 * 5/2001 Kushino et al. ..... 430/137.18

FOREIGN PATENT DOCUMENTS

| | | |
|---|---|---|
| JP | 56-113142 | 9/1981 |
| JP | 58-60752 | 4/1983 |
| JP | 63-172278 | 7/1988 |
| JP | 7-134443 | 5/1995 |
| JP | 2001-222136 | 8/2001 |
| JP | 2002-108016 | 4/2002 |

* cited by examiner

*Primary Examiner*—John L Goodrow
(74) *Attorney, Agent, or Firm*—Roylance, Abrams, Berdo & Goodman, L.L.P.

(57) ABSTRACT

A method is provided for preparing a particulate phase toner for use in an electrophotographic image forming apparatus. The method uses fractional dissolution rather than pulverization and chemical preparation. Accordingly, it is easy to control the size and the shape of toner particles. The fluidity of the toner particles according to the invention is improved. The method of the invention also reduces or eliminate the environmental pollution. A particulate phase toner prepared by the method is also provided.

15 Claims, 1 Drawing Sheet

METHOD OF PREPARING PARTICULATE PHASE TONER USING FRACTIONAL DISSOLUTION AND PARTICULATE PHASE TONER PREPARED USING THE SAME

CROSS-REFERENCE TO RELATED APPLICATIONS

This application claims the benefit under 35 U.S.C. § 119(a) of Korean Patent Application No. 2003-83048, filed on Nov. 21, 2003, in the Korean Intellectual Property Office, the disclosure of which is incorporated by reference herein in its entirety.

BACKGROUND OF THE INVENTION

1. Field of the Invention

The present invention relates to a method of preparing a particulate phase toner for use in an electrophotographic image forming apparatus. More particularly, the present invention relates to novel methods of preparing a particulate phase toner by using fractional dissolution, rather than pulverization and chemical preparation to easily control the size and a shape of toner particles. The present invention improves fluidity of the toner, eliminates the environmental pollution of the prior methods for producing the toner. The invention is also directed to the particulate phase toner prepared by the methods of the invention.

2. Description of the Related Art

The toners that are conventionally used in electrophotographic image forming apparatus include a pulverized toner prepared by pulverization or a chemically prepared toner prepared by chemical processes.

The pulverization method is a classic method for preparing a toner. This method produces a mixture by uniformly melting and dispersing a colorant, a charge controlling agent (CCA), a releasing agent, etc. in a binder resin. The mixture is pulverized to a particle size of between several micrometers and tens of micrometers by a mechanical method such as an air flow type or mechanical pulverizer. The pulverized particles are distributed according to a particle size and external additives are evenly applied to the particles such that the toner has good fluidity, charge stability, cleaning properties, and the like.

However, the method of preparing a toner by pulverization has the following problems: i) it is not easy to control the size of the prepared toner particles; ii) since a shape of the pulverized toner particle cannot be controlled, the toner particles are rough and irregular, thereby increasing the contact surface between adjacent toner particles and reducing fluidity; iii) the size distribution of the toner particle is very broad, and thus, only toner particles having a size within a particular range are fractionated again and used, resulting in a low yield; iv) it is difficult to obtain and control the electric property of the surface of the particles due to their irregular surface; v) weight distribution of the particles is broad, thereby deteriorating transfer and developing properties; and vi) it is not easy to disperse internal additives in the binder resin.

The method of preparing a toner by chemical preparation is a modified version of the method of the pulverization, in which the toner is prepared via a complicated chemical treatment process without using the pulverization. The toners prepared by this method are classified into a chemical toner, a polymerized toner, an in-situ polymerized toner, a suspension polymerized toner, an emulsion polymerized toner, an emulsion aggregation/aggregated toner, a latex aggregation/aggregated toner, a controlled agglomeration toner, a capsule toner, a microcapsule toner, an encapsulated toner, a microencapsulated toner, etc. In this method, toner particles are prepared in a chemical manner and the external process of adding additives is the same as in the pulverization.

However, the method of preparing a toner by the chemical preparation also has the following problems: i) the preparation process is complicated, which increases the price of the toner; ii) in the case of the polymerized toners, unreacted monomers, dimers, or oligomers remain and cause environmental problems, such as a bad smell, and inversely affect the durability of the toner; iii) dispersion stabilizers, surfactants, that are often used in large amounts have a negative influence on a charging property of the toner, it is difficult to remove these materials, and a complicated process is required to remove these materials; and iv) in the case of the suspension polymerized toner, the particles are completely spherical, and thus, the cleaning property of the toner is deteriorated.

SUMMARY OF THE INVENTION

The present invention provides a method of preparing a particulate phase toner in which it is easy to control the size and the shape of the toner particles. The surface roughness of the toner particle is decreased to improve the fluidity of the toner. Also, there is no concern for environmental pollution caused by fine dust generated during pulverization and unreacted low molecular weight materials generated during the chemical preparation.

According to one aspect of the present invention, a method is provided for preparing a particulate phase toner including: mixing and melting a binder resin, an internal additive including a colorant, a charge controlling agent, and a releasing agent, and a water-soluble component selected from the group consisting of a water-soluble polymer, a polysaccharide, and mixtures thereof; extruding and cooling the resulting molten material to obtain a cluster having a continuous phase formed from said water-soluble component and the binder resin in an isolated phase; pulverizing the cooled cluster to obtain particles having an average particle diameter of about 0.1 to about 5 mm; placing the particles in an aqueous solvent and dissolving the water-soluble component of the continuous phase in the particle to obtain toner particles including the binder resin and the internal additive.

According to another aspect of the present invention, a method is provided for preparing a particulate phase toner including: mixing and melting a binder resin, and an internal additive including a colorant, a charge controlling agent, and a releasing agent to form a premixed molten material; extruding and cooling the premixed molten material, and then pulverizing the resulting cooled premixed material to obtain primary particles having an average particle diameter of about 0.1 to about 5 mm; mixing and melting the primary particles with a water-soluble component selected from the group consisting of a water-soluble polymer, a polysaccharide, and mixtures thereof; extruding and cooling the molten material to obtain a cluster having a continuous phase of said water-soluble component and the binder resin in an isolated phase; pulverizing the cluster to obtain particles having an average particle diameter of about 0.1 to about 5 mm; placing the particles in an aqueous solvent and dissolving the water-soluble component of the continuous phase in the particles to obtain toner particles including the binder resin and the internal additive.

According to another aspect of the present invention, a particulate phase toner is prepared by the above methods.

The method of preparing a particulate phase toner according to certain aspects of the present invention uses fractional dissolution rather than pulverization and chemical preparation to easily control a size and a shape of a toner particle, improve fluidity of the toner, and eliminate environmental pollution.

BRIEF DESCRIPTION OF THE DRAWINGS

The above and other features and advantages of the present invention will become more apparent by describing in detail exemplary embodiments thereof with reference to the attached drawing in which.

DETAILED DESCRIPTION OF THE INVENTION

Figure 1:
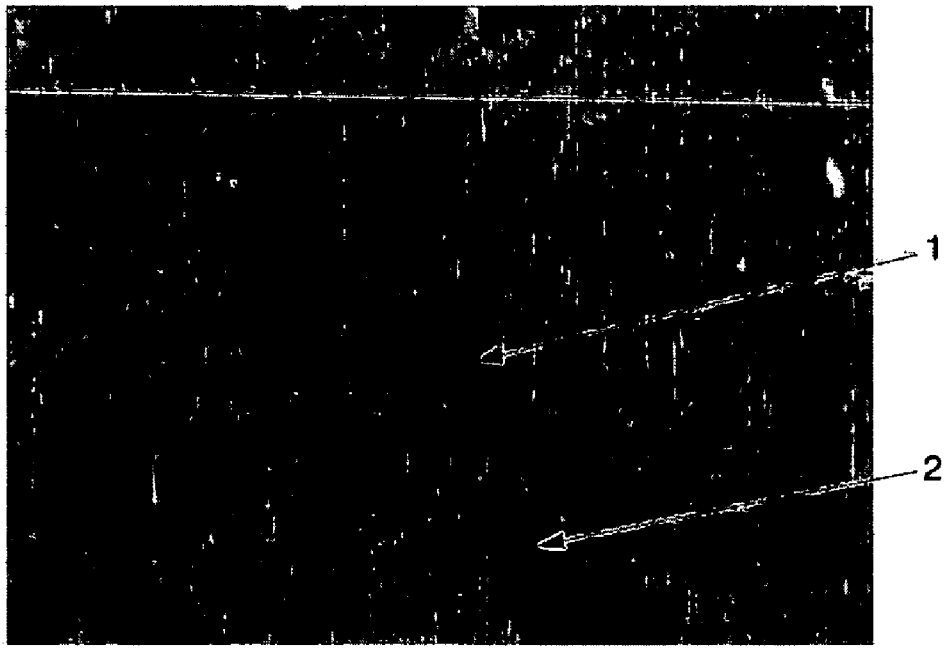
FIG. 1 is an TEM (transmission electron microscope) photomicrograph of a mixed molten material obtained by mixing and melting, in which a binder resin is in an isolated phase located among a continuous phase of a water-soluble polymer or a polysaccharide.

The present invention relates to a method of preparing a toner for use in a electrophotographic image forming apparatus, such as a laser printer, a facsimile and a photocopier. The method includes: mixing and melting a binder resin, an internal additive including a colorant, a charge controlling agent, and a releasing agent, and a water-soluble polymer, a polysaccharide, and a mixture thereof to form a mixed molten material having the water-soluble polymer or the polysaccharide as a continuous phase and the binder resin in an isolated phase; and fractional dissolving the water-soluble polymer or the polysaccharide of the resulting material in water to prepare a particulate phase toner. Also, the present invention relates to the particulate phase toner prepared by this method.

Generally, when mixing and melting two types of resins having poor compatibility, the resin with a low melt viscosity forms the continuous phase and a resin with a high melt viscosity forms the isolated phase. Most water-soluble polymers or polysaccharides have lower melt viscosity than resins used as the binder resin due to their low molecular weights. Thus, the water-soluble component forms the continuous phase and the binder resin forms the isolated phase. As used herein, the term water-soluble component refers to the material that forms a continuous phase when melted and mixed with the binder resin and other components. The water-soluble component is selected from the group consisting of water-soluble polymers, polysaccharides, and mixtures thereof. FIG. 1 is a photomicrograph of the resulting material or matrix, in which the binder resin 1 in the isolated phase is located among the continuous phase of the water-soluble polymer or the polysaccharide 2.

The toner particles are prepared by forming a substantially solid matrix of a continuous or substantially continuous phase of a water-soluble component and a discontinuous phase or isolated phase of the toner component. The toner component comprises the binder resin, internal additive containing a colorant, a charge control agent, a release agent and other desired components as known in the art of toner particles. The water-soluble component has a melting point that is compatible with the toner component to form a continuous phase encapsulating isolated particles of the toner component. In one embodiment of the invention, the water-soluble component and each of the components that form the toner component are combined and heated with continuous mixing at a temperature to melt the water-soluble component, thereby dispersing the toner component in the water-soluble component. The molten mixture of the water-soluble component and the binder component is referred to herein as the molten material.

The resulting molten material is extruded and cooled to solidify the molten water-soluble component. The cooled and solidified material is referred to herein as the mixed material.

In the method of preparing a particulate phase toner according to an embodiment of the present invention, the resulting mixed material preferably includes about 75 to about 95% by weight of the binder resin, about 0.5 to about 10% by weight of the colorant, about 0.1 to about 10% by weight of the charge controlling agent, about 0.1 to about 10% by weight of the releasing agent, and about 15 to about 45 parts by weight of the water-soluble polymer, the polysaccharide, or mixture thereof based on 100 parts by total weight of the binder resin, the colorant, the charge controlling agent, and the releasing agent.

Examples of the water-soluble component include polyvinyl alcohol (PVA), polyacrylamide, methylolated urea resin, methylolated melamine resin, a carboxymethyl cellulose (CMC), sugar, maltose, lactose, starch, glycogen and cellulose, and mixtures thereof. The water-soluble polymer, the polysaccharide, or the mixture thereof may be included in the mixed material in an amount of about 15 to about 45 parts by weight based on 100 parts by total weight of the binder resin, the colorant, the charge controlling agent, and the releasing agent.

The isolated phase toner particle may not be formed or the formed particle may be excessively large when the content of the water-soluble polymer, the polysaccharide, or the mixture thereof is less than 15 parts by weight. The amount of water required for the fractional dissolution of the continuous phase of the water-soluble component increases and the processing cost increases when the content of the continuous phase forming material is more than 45 parts by weight.

Examples of the binder resin include, but are not limited to, polystyrene butadiene copolymers, polystyrene acrylonitrile copolymers, modified acrylic polymers, polyvinyl acetate, styrene-alkyd resins, soya-alkyl resins, polyvinylchloride, polyvinylidene chloride, polyacrylonitrile, polycarbonates, polyacrylic acid, polyacrylates, polymethacrylates, styrene polymers, polyvinyl butyral, alkyd resins, polyamides, polyurethanes, polyesters, polysulfones, polyethers, polyketones, phenoxy resins, epoxy resins, silicone resins, polysiloxanes, poly(hydroxyether) resins, polyhydroxystyrene resins, Novolak resins, poly(phenylglycidylether)-dicyclopentadiene copolymers, and mixtures thereof. In other embodiments, the binder resin can be a copolymer produced from one or more of the monomers used in the foregoing polymers. The binder resin may be included in the mixed material in an amount of about 75 to about 95% by weight based on the total weight (100 parts by weight) of the toner-forming components. The toner-forming components include the binder resin, charge control agent, colorant, and releasing agent.

Examples of the charge controlling agent include an organo-metallic complex or a phenolic organic compound as known in the art. The charge controlling agent may be included in the mixed material in an amount of about 0.1 to about 5% by weight based on the total weight (100 parts by weight) of the toner-forming components.

Examples of the colorant include dyes and pigments as known in the art. Specific examples of suitable dyes and pigments include, but are not limited to, metal-free phthalocyanines for example, ELA 8034 metal-free phthalocyanine available from H.W. Sands, Inc. or CGM-X101 available from Sanyo Color Works, Ltd.; metal phthalocyanines, for example, titanium phthalocyanine, copper phthalocyanine, oxytitanium phthalocyanine, hydroxygalium phthalocyanine; scuarylium dyes and pigments; a hydroxy-substituted scuarylium pigment; pherylimides; polynuclear quinines available from Allied Chemical Corporation under the trademarks Indofast® Double Scarlet, Indofast® Violet Lake B, Indofast® Brilliant Scarlet, and Indofast® Orange; quinacrydones available from DuPont under the trademarks Monastral™ Red, Monastral™ Violet, and Monastral™ Red Y; naphthalene 1,4,5,8-tetracarboxylic acid derived pigment, including perinones, tetrabenzoporphyrines, and tetranaphthaloporphyrines; indigo- and thioindigo dyes; benzothioxanthene derivatives; pherylene 3,4,9,10-tetracarboxylic derived pigments; polyazo pigments including bisazo-, trisazo-, and tetrakisazo pigments; polymethyne dyes; quinazoline group-containing dyes; tertiary amines; selenium alloys, for example, noncrystalline selenium, selenium-tellurium, selenium-tellurium-arsenic, and selenium-arsenic; cadmium sulfoselenide; cadmium selenide; cadmium sulfide, and mixtures thereof.

The colorant may be included in the mixed material in an amount of about 0.5 to about 10% by weight based on the total weight (100 parts by weight) of the toner-forming components. The color intensity of the toner decreases when the content of the colorant is less than 0.5% by weight, and the charge property of the toner deteriorats when the colorant content is more than 10% by weight.

Examples of the releasing agent for enhancing releasability of the toner from the drum of the printing apparatus to include releasing agents that are known in the art. Specific examples thereof include, but are not limited to, fluorinated polymers, siloxane polymers, fluorosilicone polymers, polysilanes, polyethylenes, polypropylenes, polyacrylates, poly (methyl methacrylate-co-methacrylic acid), urethane resins, urethane-epoxy resins, acrylated urethane resins, urethane-acrylic resins, and combinations thereof.

The releasing agent may be included in the mixed material in an amount of about 0.1 to about 10% by weight based on the total weight (100 parts by weight) of the toner-forming components. The offset and the fusing property of the toner are deteriorated when the content of the releasing agent is less than about 0.1% by weight and the fluidity of the toner and a charge quantity may decrease and a developing member may be contaminated when the content is more than about 10% by weight.

In order to enhance the fluidity of the toner particles and promote charge stability, the mixed material may optionally include an external additive in an amount of about 0.5 to about 10 parts by weight based on 100 parts by weight of the mixed molten material. Examples of the external additive include aluminum oxide powder, colloidal silica powder, titanium oxide powder, calcium carbonate powder, and mixtures thereof.

The size of the isolated phase can be controlled by adjusting an intensity of shearing force, temperature, and time when producing the mixed material. In other words, as the intensity of shearing force increases, the size of the formed toner particle becomes smaller. The mixing and processing temperature determines melt viscosities of the binder resin and the water-soluble polymer or the polysaccharide. Thus, the temperature is appropriately established according to melt viscosities of the binder resin and the water-soluble polymer or the polysaccharide. The processing time or transferring rate means the time when the materials are present in a mixer. Thus, the processing time influences dispersion and particle formation and a longer processing time is advantageous to particle formation. The processing time and the shear force are independently selected and adjusted to produce the desired size of the isolated particles containing the binder resin.

The processing condition is established by considering the shape of an extruder screw and the compatibility of the binder resin and the water-soluble polymer or the polysaccharide, as well as the above factors.

After forming the molten material, the binder resin slowly agglomerates in the continuous phase formed from the water-soluble polymer or the polysaccharide during cooling of the molten material. At this time, the size and the spherical degree of the binder resin particle can be controlled by adjusting the cooling rate of the molten material. The cooling rate of the molten material may be about 0.1 to about 20° C./min considering the agglomerating rate of the water-soluble polymer or the polysaccharide.

The resulting cooled mixed material is moderately pulverized to form particles having an average particle diameter of about 0.1 to about 5 mm to increase the rate that the continuous phase dissolves in an aqueous solvent. The resulting particles produced by cooling and moderately pulverizing, have a continuous phase of the water-soluble polymer or the polysaccharide which is dissolved in the aqueous solvent. The binder resin containing the internal additive remains in a solid phase in the aqueous solvent to form the particulate phase toner. The temperature of the dissolving solvent may be at the glass transition temperature of the binder resin ±10° C. Preferably, the temperature of the aqueous solvent is within 5° C. (±5° C.) of the glass transition temperature of the binder resin. This is because the toner particles aggregate at a temperature well above the glass transition temperature, and the dissolving rate increases. Furthermore, the spherical degree of the dissolved particle is improved when the continuous phase is dissolved at temperatures around the glass transition temperature of the binder resin.

As described above, in the method according to an embodiment of the present invention, the molten material for producing the particulate phase toner is formed in a one-step process, in which the binder resin, the internal additive, and the water-soluble polymer, the polysaccharide, or the mixture thereof are simultaneously mixed at a temperature to melt the water-soluble polymer or polysaccharide.

In another embodiment of the present invention, the mixed material is formed by a two-step process. In this embodiment, a premixed molten material is formed by mixing and heating the binder resin and the internal additive to form a molten material, extruding and cooling the molten material to form a mixed material, extruding and pulverizing the mixed material to obtain first particles having a particle size of about 0.1 to about 5 mm. The first particles are mixed with the water-soluble polymer, the polysaccharide, or mixtures thereof to form a mixture. The mixture is mixed and heated to melt the water-soluble component. The resulting molten material is extruded and cooled to form a cluster having a continuous phase of the water-soluble component and an isolated phase of the binder resin. The cluster is pulverized to a particle size of about 0.1 to about 5 mm and then treated with the aqueous solvent to dissolve the water-soluble component and recover the isolated toner particles.

The two-step process is relatively more advantageous than the one-step process in terms of dispersion of the internal additive since the internal additive is mixed with binder resin before mixing the water-soluble polymer, the polysaccharide, or the mixture thereof.

Also, according to another embodiment of the present invention, a particulate phase toner is prepared by the above methods.

The present invention will now be described in greater detail with reference to the following examples. The following examples are for illustrative purposes only, and are not intended to limit the scope of the invention.

EXAMPLE 1

A polyester resin (a number average molecular weight: 3,000, a weight average molecular weight: 60,000, Tg: 60° C.) was used as the binder resin and a water-soluble polyvinylalcohol was used as the water-soluble polymer. The ratio of the toner particle forming part was established to be 92% by weight of the polyester resin, 3% by weight of the charge controlling agent (Fe complex available from Hodogaya), 3% by weight of the colorant (carbon black available from Cabot), and 2% by weight of the releasing agent (PE wax available from Clariant). The water-soluble polyvinylalcohol was added in an amount of 30% by weight of the total weight to the toner particle forming components. The combination of the components was premixed and extruded through an extruder. The extruded material was then cooled at a cooling rate of 10° C./min. The resulting cooled material was moderately pulverized to an average particle diameter of about 1 mm using a moderate pulverizer. Then, the pulverized material was poured into warm water of 55° C. to fractionally dissolve the water-soluble polyvinylalcohol and separate the toner particles from the polyvinyl alcohol. The toner particles were dried using a spray drier.

EXAMPLE 2

A styrene/acrylate copolymer resin (a number average molecular weight: 5,500, a weight average molecular weight: 68,000, Tg: 65° C.) was used as the binder resin. A water-soluble polyvinylalcohol was used as the water-soluble polymer and sugar (sucrose) was used as the polysaccharide. The toner particle forming component was prepared and contained 92% by weight of the styrene acrylate copolymer resin, 3% by weight of the charge controlling agent (Fe complex available from Hodogaya), 3% by weight of the colorant (carbon black available from Cabot), and 2% by weight of the releasing agent (PE wax available from Clariant). A 1:2 mixture of the water-soluble polyvinylalcohol and sugar was added in an amount of 30% by weight based on the total weight of the resulting mixture. The mixture was premixed and extruded through an extruder. The extruded material was cooled at a cooling rate of 5° C./min. The cooled material was moderately pulverized to an average particle diameter of about 1 mm using a moderate pulverizer. Then, the pulverized material was poured into warm water at 60° C. to fractionally dissolve the mixture of the water-soluble polyvinylalcohol and sugar and separate the toner particles. The toner particles were dried using a spray drier.

As described above, a novel method of preparing a particulate phase toner according to embodiments of the present invention i) uses fractional dissolving rather than pulverization or chemical preparation, ii) can easily control the size and the shape of a toner particle by adjusting the compatibility of the binder resin and the water-soluble polymer, the type and the melt viscosity of the water-soluble polymer and the polysaccharide, the mixing and melting conditions (for example, shearing force, temperature, etc.), and the cooling rate after extruding the matrix material, iii) can improve the fluidity of the toner particle by reducing the surface roughness of the toner particle, and iv) eliminates environmental pollution due to fine dusts produced when pulverizing and unreacted low molecular weight materials.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A method of preparing a particulate phase toner, the method comprising the steps of:

mixing and melting a binder resin; an internal additive including a colorant, a charge controlling agent, and a releasing agent; and a water-soluble component selected from the group consisting of a water-soluble polymer, a polysaccharide, and mixtures thereof to produce a molten material;

extruding and cooling the resulting molten material to obtain a cluster having a continuous phase formed from said water-soluble component and said binder resin in an isolated phase;

pulverizing the cooled cluster to obtain particles having an average particle diameter of about 0.1 to about 5 mm; and placing the particles in an aqueous solvent and dissolving the water-soluble component of the continuous phase in the particles to obtain toner particles including said binder resin and said internal additive.

2. A method of preparing a particulate phase toner, the method comprising the steps of:

mixing and melting a binder resin and an internal additive including a colorant, a charge controlling agent, and a releasing agent to form a premixed molten material;

extruding and cooling the premixed molten material and pulverizing the resulting cooled premixed material to obtain primary particles having an average particle diameter of about 0.1 to about 5 mm;

mixing and melting the primary particles with a water-soluble component selected from the group consisting of a water-soluble polymer, a polysaccharide, and mixtures thereof to produce a molten material;

extruding and cooling the molten material to obtain a cluster having a continuous phase formed from said water-soluble component and the binder resin in an isolated phase;

pulverizing the cluster to obtain particles having an average particle diameter of about 0.1 to about 5 mm; and placing the particles in an aqueous solvent and dissolving the water-soluble component from the continuous phase in the particle to obtain toner particles including the binder resin and the internal additive.

3. The method of claim 1, wherein the molten material comprises about 75 to about 95% by weight of the binder resin, about 0.5 to about 10% by weight of the colorant, about 0.1 to about 10% by weight of the charge controlling agent, about 0.1 to about 10% by weight of the releasing agent based on the total weight of the molten material, and 15-45 parts by weight of the water-soluble component based on 100 parts by total weight of the binder resin, the colorant, the charge controlling agent, and the releasing agent.

4. The method of claim 1, wherein the water-soluble component is selected from the group consisting of polyvinyl alcohol, polyacrylamide, methylolated urea resin, methylolated melamine resin, carboxymethyl cellulose, sugar, maltose, lactose, starch, glycogen, cellulose, and mixtures thereof.

5. The method of claim 1, wherein the molten material further comprises an external additive selected from the group consisting of aluminum oxide powder, colloidal silica powder, titanium oxide powder, calcium carbonate powder, and mixtures thereof wherein said external additive is included in an amount of about 0.5 to about 10 parts by weight based on 100 parts by weight of the molten material.

6. The method of claim 1, further comprising cooling said molten material at a rate of about 0.1 to about 20° C./min.

7. The method of claim 1, wherein said aqueous solvent is at a temperature within 5° C. of the glass transition temperature of the binder resin.

8. The method of claim 1, wherein the binder resin is selected from the group consisting of polystyrene-co-butadiene, polystyrene-co-acrylonitrile, modified acrylic polymer, polyvinyl acetate, styrene-alkyd resins, soya-alkyl resins, polyvinylchloride, polyvinylidene chloride, polyacrylonitrile, polycarbonates, polyacrylic acid, polyacrylates, polymethacrylates, styrene polymers, polyvinyl butyral, alkyd resins, polyamides, polyurethanes, polyesters, polysulfones, polyethers, polyketones, phenoxy resins, epoxy resins, silicone resins, polysiloxanes, poly(hydroxyether) resins, polyhydroxystyrene resins, Novolak resin, poly(phenylglycidylether)-co-dicyclopentadiene, copolymers of monomers used in the foregoing polymers, and mixtures thereof.

9. A particulate phase toner prepared by a method including the steps of mixing and melting a binder resin; an internal additive including a colorant, a charge controlling agent, and a releasing agent; and a water-soluble component selected from the group consisting of a water-soluble polymer, a polysaccharide, and mixtures thereof to produce a molten material;

extruding and cooling the resulting molten material to obtain a cluster having a continuous phase formed from said water-soluble component and said binder resin in an isolated phase;

pulverizing the cooled cluster to obtain particles having an average particle diameter of about 0.1 to about 5 mm; and placing the particles in an aqueous solvent and dissolving the water-soluble component of the continuous phase in the particles to obtain toner particles including said binder resin and said internal additive.

10. The method of claim 2, wherein the molten material comprises about 75 to about 95% by weight of the binder resin, about 0.5 to about 10% by weight of the colorant, about 0.1 to about 10% by weight of the charge controlling agent, about 0.1 to about 10% by weight of the releasing agent based on the total weight of molten material, and 15-45 parts by weight of the water-soluble component based on 100 parts by total weight of the binder resin, the colorant, the charge controlling agent, and the releasing agent.

11. The method of claim 2, wherein the water-soluble component is selected from the group consisting of polyvinyl alcohol, polyacrylamide, methylolated urea resin, methylolated melamine resin, carboxymethyl cellulose, sugar, maltose, lactose, starch, glycogen, cellulose, and mixtures thereof.

12. The method of claim 2, wherein the molten material further comprises an external additive selected from the group consisting of aluminum oxide powder, colloidal silica powder, titanium oxide powder, calcium carbonate powder, and mixtures thereof wherein said external additive is included in an amount of about 0.5 to about 10 parts by weight based on 100 parts by weight of the molten material.

13. The method of claim 2, further comprising cooling said molten material at a rate of about 0.1 to about 20° C./min.

14. The method of claim 2, wherein said aqueous solvent is at a temperature within 5° C. of the glass transition temperature of the binder resin.

15. The method of claim 2, wherein the binder resin is selected from the group consisting of polystyrene-co-butadiene, polystyrene-co-acrylonitrile, modified acrylic polymer, polyvinyl acetate, styrene-alkyd resins, soya-alkyl resins, polyvinylchloride, polyvinylidene chloride, polyacrylonitrile, polycarbonates, polyacrylic acid, polyacrylates, polymethacrylates, styrene polymers, polyvinyl butyral, alkyd resins, polyamides, polyurethanes, polyesters, polysulfones, polyethers, polyketones, phenoxy resins, epoxy resins, silicone resins, polysiloxanes, poly(hydroxyether) resins, polyhydroxystyrene resins, Novolak resin, poly(phenylglycidylether)-co-dicyclopentadiene, copolymers of monomers used in the foregoing polymers, and mixtures thereof.

* * * * *